US006890695B2

(12) United States Patent
Shirai et al.

(10) Patent No.: US 6,890,695 B2
(45) Date of Patent: May 10, 2005

(54) TONER FOR ELECTROPHOTOGRAPHY

(75) Inventors: Eiji Shirai, Wakayama (JP); Katsutoshi Aoki, Wakayama (JP); Masayuki Maruta, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/105,239

(22) Filed: Mar. 26, 2002

(65) Prior Publication Data

US 2003/0039910 A1 Feb. 27, 2003

(30) Foreign Application Priority Data

Mar. 27, 2001 (JP) ..... 2001-091327

(51) Int. Cl.[7] ..... G03G 9/087
(52) U.S. Cl. ..... 430/109.4
(58) Field of Search ..... 430/109.4, 109.3, 430/110.3

(56) References Cited

U.S. PATENT DOCUMENTS 5,057,392 A * 10/1991 McCabe et al. ..... 430/109.4
6,383,705 B2 * 5/2002 Aoki et al. ..... 430/109.4

FOREIGN PATENT DOCUMENTS

JP 62-276565 A 12/1987
JP 5-44029 B2 7/1993
JP 2001-042564 A 2/2001
JP 2001-042568 A 2/2001

OTHER PUBLICATIONS

Diamond, A.S ed *Handbook of Imaging Materials*, Marcel Dekker, Inc., NY (1991), p. 170, 1991.*

Derwent Abstract Acc. No 1998–179035/198826 describing Japanese Patent B–HEI–5–44032, 1998.

Derwent Abstract Acc. No. 1981–52666D/198129 describing Japanese Patent 56–065146A, 1981.

Micropatent English Language Abstract Describing JP 62–276565 A & JP 5–44029 B2.

* cited by examiner

*Primary Examiner*—Janis L. Dote
(74) *Attorney, Agent, or Firm*—Birch, Stewart, Kolasch & Birch LLP

(57) ABSTRACT

A toner for electrophotography comprising a resin binder comprising a crystalline polyester and an amorphous resin, wherein said crystalline polyester is dispersed in the resin binder in an amount of from 1 to 40% by weight, and wherein 90% or more of a dispersed domain of said crystalline polyester has a diameter of from 0.1 to 2 $\mu$m. The toner for electrophotography can be suitably used for developing electrostatic latent images formed in electrophotography, electrostatic recording method, electrostatic printing, and the like.

11 Claims, 3 Drawing Sheets

TONER FOR ELECTROPHOTOGRAPHY

BACKGROUND OF THE INVENTION

1. Field of the Invention

The present invention relates to a toner for electrophotography used for developing electrostatic latent images formed in electrophotography, electrostatic recording method, electrostatic printing, and the like.

2. Discussion of the Related Art

For the purpose of improvement in low-temperature fixing ability, which is one of the major problems to be solved in electrophotography, there are proposed a toner comprising an amorphous resin binder having a low glass transition point, and a toner comprising a wax having a low melting point. However, the improvement in low-temperature fixing ability is limited with these toners, and the storage property of toner is likely to be deteriorated when a large amount of an amorphous resin having a low glass transition point or wax having a low melting point is added. Therefore, there has been studied a toner comprising a resin binder comprising a crystalline polyester having more excellent low-temperature fixing ability. However, while crystalline polyester has the excellent property described above, it has a defect when used alone that the storage property and the offset resistance are deteriorated, thereby to narrow the fixable temperature range.

In addition, in the case where the backbones of a crystalline polyester and an amorphous polyester are almost the same, as in the toner disclosed in Japanese Examined Patent Publication No. Sho 62-39428, the dispersibility of the crystalline polyester is so high that a large amount of the crystalline polyester exposed on the surface of the toner causes deterioration of the storage property.

An object of the present invention is to provide a toner for electrophotography which has excellent low-temperature fixing ability and storage property, and which provides high-quality fixed images.

SUMMARY OF THE INVENTION

The present invention relates to a toner for electrophotography comprising a resin binder comprising a crystalline polyester and an amorphous resin, wherein the crystalline polyester is dispersed in the resin binder in an amount of from 1 to 40% by weight, and wherein 90% or more of a dispersed domain of the crystalline polyester has a diameter of from 0.1 to 2 $\mu$m.

DETAILED DESCRIPTION OF THE INVENTION

Figure 1:
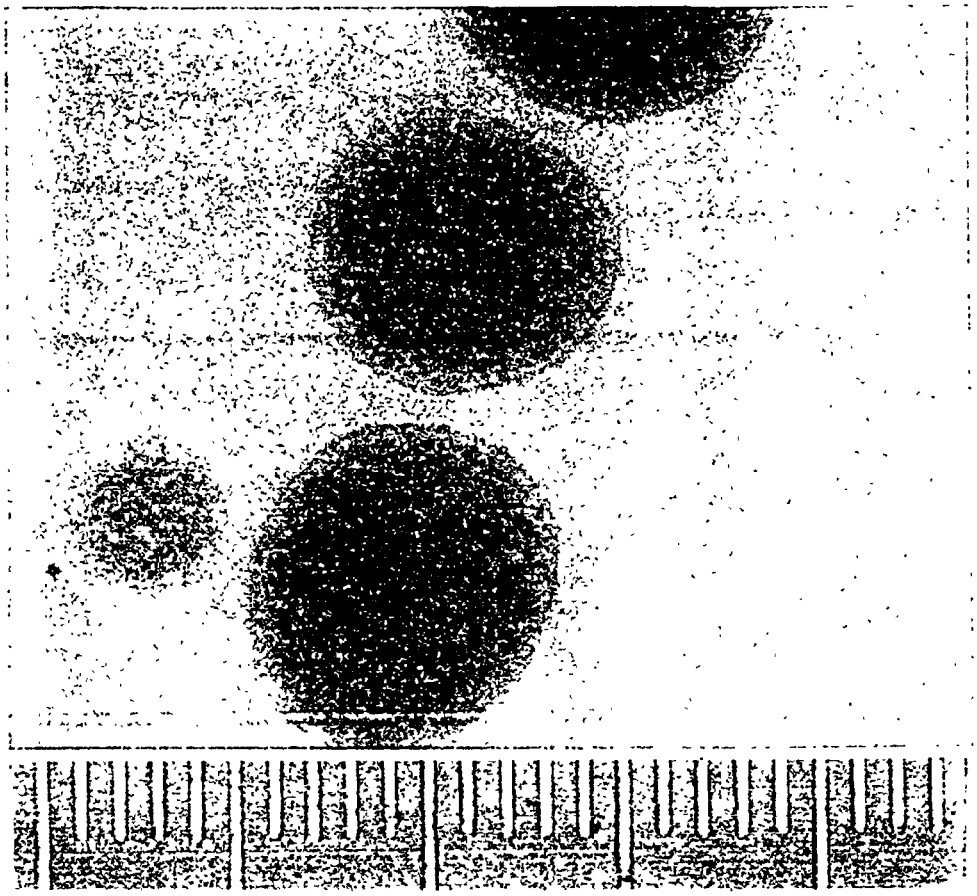
FIG. 1 is an electron micrograph of the toner obtained in Example 5 of the present specification, wherein a single measurement scale corresponds to a length of 1 $\mu$m.

The toner of the present invention, which comprises a resin binder comprising a crystalline polyester and an amorphous resin, is characterized in that the dispersibility of the crystalline polyester is appropriately adjusted. In the case where the amount of a crystalline polyester contained is too large, or in the case where the compatibility between a crystalline polyester and an amorphous resin is too high, the storage property of toner is deteriorated by a large amount of the crystalline polyester exposed on the surface of the toner. Also, in the case where the dispersibility of a crystalline polyester is insufficient, image quality is deteriorated due to the unevenness of the triboelectric charges. Therefore, the present inventors conducted intensive studies on the dispersibility of crystalline polyester and its effects. As a result, it has been found that when 90% or more of the dispersed domain of the crystalline polyester has a diameter of from 0.1 to 2 $\mu$m, preferably when 90% or more of the dispersed domain has a diameter of from 0.1 to 2 $\mu$m and 50% or more of the dispersed domain has a diameter of from 0.1 to 1 $\mu$m, all of the low-temperature fixing ability, the storage property and the evenness of the triboelectric charges can be attained. Incidentally, in the present invention, the dispersed domain refers to a domain having a diameter of 0.05 $\mu$m or more. "90% or more of the dispersed domain of the crystalline polyester has a diameter of from 0.1 to 2 $\mu$m" means that 90% by area or more of the dispersed domain has a diameter of from 0.1 to 2 $\mu$m when a toner particle is observed using a microscope at a magnification of 2000. In addition, in the case where the dispersed domain is elliptical, an average value of lengths of the major axis and the minor axis is defined as a diameter.

The dispersibility of the crystalline polyester can be appropriately adjusted by taking into consideration the combination of raw material monomers used for the crystalline polyester and the amorphous resin, the softening points for the crystalline polyester and the amorphous resin, kneading conditions of the crystalline polyester and the amorphous resin during the preparation of toner, and the like.

The resin binder in the present invention comprises the crystalline polyester and the amorphous resin, as described above. The resin binder may comprise a crystalline resin other than the polyester in an appropriate amount. However, the crystalline polyester and the amorphous resin are contained in the resin binder in a total amount of preferably from 50 to 100% by weight, more preferably from 80 to 100% by weight, especially preferably 100% by weight.

In the present invention, the crystalline polyester is preferably a resin obtained by polycondensing an alcohol component comprising 80% by mol or more of an aliphatic diol having 2 to 6 carbon atoms, preferably 4 to 6 carbon atoms, with a carboxylic acid component comprising 80% by mol or more of an aliphatic dicarboxylic acid compound having 2 to 8 carbon atoms, more preferably 4 to 6 carbon atoms, more preferably 4 carbon atoms (hereinafter referred to as an aliphatic crystalline polyester).

The aliphatic diol having 2 to 6 carbon atoms includes 1,4-butanediol, ethylene glycol, 1,2-propylene glycol, 1,3-propylene glycol, 1,6-hexanediol, neopentyl glycol, 1,4-butenediol, 1,5-pentanediol and the like, among which $\alpha$, $\omega$-linear alkyl diol is especially preferable.

It is desirable that the aliphatic diols having 2 to 6 carbon atoms are contained in the alcohol component in an amount of 80% by mol or more, preferably from 90 to 100% by mol, more preferably from 95 to 100% by mol. Especially, it is desirable that one of the aliphatic diols constitutes 70% by mol or more, preferably 80% by mol or more, more preferably from 85 to 95% by mol of the alcohol component.

A dihydric alcohol component which the alcohol component may comprise other than the aliphatic diol having 2 to 6 carbon atoms includes aromatic alcohols such as an alkylene oxide adduct of bisphenol A which is represented by Formula (I):

(I)

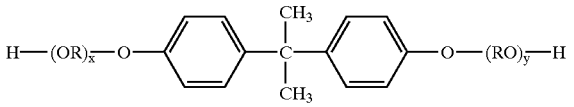

wherein R represents an alkylene group having 2 or 3 carbon atoms; x and y are a positive number; and the sum of x and y is 1 to 16, preferably 1.5 to 5.0, such as polyoxypropylene (2,2)-2,2-bis(4-hydroxyphenyl)propane and polyoxyethylene(2.2)-2,2-bis(4-hydroxyphenyl)propane; diethylene glycol, triethylene glycol, 1,8-octanediol, 1,4-cyclohexanedimethanol, dipropylene glycol, polyethylene glycol, polypropylene glycol, polytetramethylene glycol, hydrogenated bisphenol A, and the like.

The trihydric or higher polyhydric alcohol component includes aromatic alcohols such as 1,3,5-trihydroxymethylbenzene; aliphatic alcohols such as sorbitol, 1,2,3,6-hexanetetrol, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane; cycloaliphatic alcohols such as 1,4-sorbitan; and the like.

The aliphatic dicarboxylic acid compound having 2 to 8 carbon atoms includes oxalic acid, malonic acid, maleic acid, fumaric acid, citraconic acid, itaconic acid, glutaconic acid, succinic acid, adipic acid, acid anhydrides thereof, alkyl (1 to 3 carbon atoms) esters thereof, and the like. Incidentally, as described above, the aliphatic dicarboxylic acid compound refers to aliphatic dicarboxylic acids, acid anhydrides thereof and alkyl (1 to 3 carbon atoms) esters thereof, among which aliphatic dicarboxylic acids are preferable.

It is desirable that the aliphatic dicarboxylic acid compounds having 2 to 8 carbon atoms are contained in the carboxylic acid component in an amount of 80% by mol or more, preferably from 90 to 100% by mol, more preferably from 95 to 100% by mol. Especially, it is desirable that one of the aliphatic dicarboxylic acid compounds constitutes 80% by mol or more, preferably from 90 to 100% by mol, of the carboxylic acid component.

A dicarboxylic acid component which the carboxylic acid component may comprise other than the aliphatic dicarboxylic acid compound having 2 to 8 carbon atoms includes aromatic carboxylic acids such as phthalic acid, isophthalic acid, terephthalic acid; aliphatic carboxylic acids such as sebacic acid, azelaic acid, n-dodecylsuccinic acid and n-dodecenylsuccinic acid; cycloaliphatic carboxylic acids such as cyclohexanedicarboxylic acid; acid anhydrides thereof, alkyl (1 to 3 carbon atoms) esters thereof, and the like.

The tricarboxylic or higher polycarboxylic acid component includes aromatic carboxylic acids such as 1,2,4-benzenetricarboxylic acid (trimellitic acid), 2,5,7-naphthalenetricarboxylic acid, 1,2,4-naphthalenetricarboxylic acid and pyromellitic acid; aliphatic carboxylic acids such as 1,2,4-butanetricarboxylic acid, 1,2,5-hexanetricarboxylic acid, 1,3-dicarboxyl-2-methyl-2-methylenecarboxypropane, tetra(methylenecarboxyl)methane and 1,2,7,8-octanetetracarboxylic acid; cycloaliphatic carboxylic acids such as 1,2,4-cyclohexanetricarboxylic acid; derivatives thereof such as acid anhydrides thereof and alkyl (1 to 3 carbon atoms) esters thereof; and the like.

The polycondensation of the alcohol component with the carboxylic acid component can be carried out, for instance, by the reaction at a temperature of from 120° to 230° C. in an inert gas atmosphere, using an esterification catalyst and a polymerization inhibitor as occasion demands. Concretely, in order to enhance the strength of the resin, the entire monomers may be charged at once. Alternatively, in order to reduce the low-molecular weight components, divalent monomers are firstly reacted, and thereafter trivalent or higher polyvalent monomers are added and reacted. In addition, the reaction may be promoted by reducing the pressure of the reaction system in the second half of the polymerization.

Here, in the present invention, the term "crystalline" means that a ratio of the softening point to the maximum peak temperature of heat of fusion (softening point/maximum peak temperature of heat of fusion) is from 0.6 or more and less than 1.1, preferably from 0.9 or more and less than 1.1, more preferably from 0.98 to 1.05. Also, the term "amorphous" means that a ratio of the softening point to the maximum peak temperature of heat of fusion (softening point/maximum peak temperature of heat of fusion) is from 1.1 to 4.0, preferably from 1.5 to 3.0.

The crystalline polyester has a softening point of preferably from 85° to 150° C., more preferably from 100° to 140° C., especially preferably from 110° to 130° C. The maximum peak temperature of heat of fusion is preferably from 77° to 150° C., more preferably from 90° to 140° C., especially preferably from 110° to 130° C.

Incidentally, in the case where the crystalline polyester comprises two or more resins, it is desirable that at least one of them, preferably all of them, is the crystalline polyester described above.

The content of the crystalline polyester is from 1 to 40% by weight, preferably from 5 to 40% by weight, more preferably from 10 to 35% by weight, of the resin binder from the viewpoints of the storage property and the low-temperature fixing ability.

The amorphous resin may be any of polyesters, polyester-polyamides, styrene-acrylic resins and the like. In the present invention, polyesters are preferable from the viewpoints of the fixing ability and the compatibility with the crystalline polyester.

The amorphous polyester is obtained by polycondensing raw material monomers comprising a polyhydric alcohol component and a polycarboxylic acid component such as a carboxylic acid, a carboxylic acid anhydride and a carboxylic acid ester.

The polyhydric alcohol component includes an alkylene(2 to 3 carbon atoms) oxide(average number of moles: 1 to 10) adduct of bisphenol A such as polyoxypropylene(2.2)-2,2-bis(4-hydroxyphenyl)propane and polyoxyethylene(2.2)-2,2-bis(4-hydroxyphenyl)propane, ethylene glycol, propylene glycol, neopentyl glycol, glycerol, pentaerythritol, trimethylolpropane, hydrogenated bisphenol A, sorbitol or alkylene(2 to 3 carbon atoms) oxide(average number of moles: 1 to 10) adducts thereof, and the like. The polyhydric alcohol component preferably comprises one or more of the above compounds.

Also, the polycarboxylic acid component includes dicarboxylic acids such as phthalic acid, isophthalic acid, terephthalic acid, fumaric acid and maleic acid; a substituted succinic acid of which substituent is an alkyl group having 1 to 20 carbon atoms or an alkenyl group having 2 to 20 carbon atoms, such as dodecenylsuccinic acid and octylsuccinic acid; trimellitic acid, pyromellitic acid; acid anhydrides thereof, alkyl(1 to 3 carbon atoms) esters thereof; and the like. The polycarboxylic acid component preferably comprises one or more of the above compounds.

The amorphous polyester can be prepared in the same manner as in the crystalline polyester. However, in order to obtain the amorphous resin, it is preferable that at least one of the alcohol component and the carboxylic acid component comprises two or more compounds, more preferably from 2 to 4 compounds. Each of the compounds is contained in the respective components in an amount of preferably from 10 to 70% by mol, more preferably from 20 to 60% by mol. Especially, in the case where the crystalline polyester is an aliphatic crystalline polyester, it is preferable that a compound, other than the aliphatic diol having 2 to 6 carbon atoms and the aliphatic dicarboxylic acid compound having 2 to 8 carbon atoms, such as an alkylene oxide adduct of bisphenol A, an aromatic carboxylic acid compound and a substituted succinic acid of which substituent is an alkyl group or an alkenyl group, is contained in the alcohol component and the carboxylic acid component, more preferably in the both components, in an amount of 30% by mol or more, more preferably from 50 to 100% by mol. Here, in order to obtained the amorphous resin, it is preferable that at least one of the alcohol component and the carboxylic acid component comprises two or more compounds, of which each amount is from 10 to 70% by mol, preferably from 20 to 60% by mol, of the component, or comprises at least one selected from the group consisting of an alkylene oxide adduct of bisphenol A, an aromatic carboxylic acid compound, and a substituted succinic acid compound of which substituent is an alkyl group or an alkenyl group in an amount of 30% by mol or more, more preferably from 50 to 100% by mol.

Generally, the compatibility between a crystalline polyester and an amorphous resin is low. When the backbones of a crystalline polyester and an amorphous resin are similar, the both are likely to be compatible. Therefore, in order to have the dispersibility of the crystalline polyester within the desired range, it is preferable that the backbones of the crystalline polyester and the amorphous resin are different to some extent.

In the present invention, it is preferable that the aliphatic crystalline polyester is combined with, as an amorphous resin, a resin obtained by polymerizing a raw material monomer comprising 5 to 70% by weight, preferably 10 to 50% by weight of an aliphatic compound. In the case where the crystalline polyester is a resin obtained by polycondensing a raw material monomer comprising 0.1 to 10% by weight of an aromatic compound, the crystalline polyester is preferably combined with an amorphous resin (an aromatic amorphous resin) obtained by polymerizing a raw material monomer comprising 50 to 95% by weight, preferably 60 to 90% by weight of an aromatic compound. In addition, the dispersibility of the crystalline polyester can also be improved by combining as a compatibility-improver an amorphous resin (aliphatic amorphous resin) obtained by polymerizing a raw material monomer comprising 20 to 70% by weight of an aliphatic compound, even in the case where the aliphatic crystalline polyester is used in combination with the aromatic amorphous resin. In this case, it is preferable that the content of the aromatic compound in the raw material monomer for the aliphatic amorphous resin used as a compatibility-improver is 10 to 50% by weight lower than the content of the aromatic compound in the raw material monomer for the aromatic amorphous resin. Incidentally, in the present invention, the aromatic compound refers to a compound having an aromatic ring such as an alkylene oxide adduct of bisphenol A, terephthalic acid and trimellitic acid, and the aliphatic compound refers to a compound having no aromatic ring such as ethylene glycol, neopentyl glycol, dodecenylsuccinic acid and fumaric acid.

The amorphous resin has a softening point of preferably from 70° to 180° C., more preferably from 100° to 160° C., a maximum peak temperature of heat of fusion of preferably from 50° to 85° C., more preferably from 60° to 75° C., a glass transition point of preferably from 45° to 80° C., more preferably from 55° to 75° C., and a weight percentage of component insoluble to chloroform of preferably from 0 to 50% by weight. Incidentally, glass transition point is a physical property characteristic of an amorphous resin, and is discriminated from maximum peak temperature of heat of fusion.

Incidentally, in the case where the amorphous resin comprises two or more resins, it is desirable that at least one of them, preferably all of them, is the amorphous resin having the properties described above.

The weight ratio of the crystalline polyester to the amorphous resin (crystalline polyester/amorphous resin) is preferably from 1/99 to 40/60, more preferably from 10/90 to 35/65, from the viewpoints of the storage property and the low-temperature fixing ability.

Further, it is preferable that the toner of the present invention comprises a wax as a releasing agent. The wax includes natural waxes such as carnauba wax and rice wax; synthetic waxes such as polypropylene wax, polyethylene wax and Fischer-Tropsch wax; coal waxes such as montan wax, alcohol waxes, ester waxes, and the like. These waxes may be contained alone or in admixture of two or more kinds. Among these waxes, carnauba wax and polyethylene wax are preferable, from the viewpoint of the compatibility with the resin binder.

It is desirable that the melting point of the wax is the temperature lower than the softening point of the crystalline polyester, or the softening point of the crystalline polyester having the lowest softening point in the case where two or more crystalline polyesters are contained, by 10° C. or more, preferably 10° to 50° C. It is preferable that the content of the wax is from 0.5 to 10 parts by weight based on 100 parts by weight of the resin binder.

The toner for electrophotography of the present invention can further contain in appropriate amounts additives such as colorants, charge control agents, electric conductivity modifiers, extenders, reinforcing fillers such as fibrous substances, antioxidants, anti-aging agents, fluidity improvers, and cleanability improvers.

As the colorants, all of the dyes and pigments which are used as colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carnine 6B, disazoyellow, and the like. These colorants can be used alone or in admixture of two or more kinds. The toner of the present invention can be used for any of black toner, color toner and full-color toner. The content of the colorant is preferably from 1 to 10 parts by weight based on 100 parts by weight of the resin binder.

The charge control agents include positively chargeable charge control agents such as Nigrosine dyes, triphenylmethane-based dyes containing a tertiary amine as a side chain, quaternary ammonium salt compounds, polyamine resins and imidazole derivatives, and negatively chargeable charge control agents such as metal-containing azo dyes, copper phthalocyanine dyes, metal complexes of alkyl derivatives of salicylic acid.

The toner of the present invention is preferably a pulverized toner, which is produced by a kneading-pulverization method or the like, comprising, for instance, homogeneously mixing a resin binder, a colorant, and the like in a mixer such as a ball-mill, thereafter melt-kneading with a kneader such as a closed kneader, a single-screw or twin-screw extruder or a continuous twin roller-type kneader, cooling, pulverizing and classifying the product. In the present invention, there is preferable a toner produced by a method comprising melt-kneading components comprising a resin binder with a kneader, more preferably with a continuous twin roller-type kneader, from the viewpoint of increasing the dispersibility of the crystalline polyester. Further, a fluidity improver and the like may be added to the surface of the toner as occasion demands. The volume-average particle size of the resulting toner is preferably from 3 to 15 μm.

Incidentally, in the present invention, in order to disperse the crystalline polyester to the desired extent, there can be used an adjustment means such as a method of appropriately selecting the kneading conditions such as setting the rotational speed of a high-speed roll at from 50 to 100 rpm and the rotational speed of a low-speed roll at a lower rotational speed than that of the high-speed roll by 10 to 30 rpm, and setting the temperature of the rolls at 70° to 150° C. in a continuous twin roller-type kneader; a method comprising previously mixing the crystalline polyester and the amorphous resin for about 30 minutes, and thereafter subjecting the resulting mixture to melt-kneading; a method comprising finely pulverizing the crystalline polyester, and thereafter subjecting the resulting pulverized product to melt-kneading; and a method comprising adjusting the softening points of the crystalline polyester and the amorphous resin and the kneading temperature.

The softening point of the toner of the present invention is preferably from 90° to 150° C., more preferably from 110° to 145° C., from the viewpoints of the low-temperature fixing ability and the storage property.

The toner for electrophotography of the present invention is used alone as a developer, in a case where the fine magnetic material powder is contained. Alternatively, in a case where the fine magnetic material powder is not contained, the toner may be used as a nonmagnetic one-component developer, or the toner can be mixed with a carrier and used as a two-component developer. Among them, it is preferable that the toner for of the present invention is used as a two-component developer which is easily chargeable.

EXAMPLES

[Softening Point]

Softening point refers to a temperature corresponding to ½ of the height (h) of the S-shaped curve showing the relationship between the downward movement of a plunger (flow length) and temperature, namely, a temperature at which a half of the resin flows out, when measured by using a flow tester of the "koka" type ("CFT-500D," commercially available from Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Maximum Peak Temperature of Heat of Fusion and Glass Transition Point]

The maximum peak temperature of heat of fusion is determined using a differential scanning calorimeter ("DSC Model 210," commercially available from Seiko Instruments, Inc.), by raising its temperature to 200° C., cooling the hot sample to 0° C. at a cooling rate of 10° C./min., and thereafter heating the sample so as to raise the temperature at a rate of 10° C./min. In addition, the glass transition point refers to the temperature of an intersection of the extension of the baseline of equal to or lower than the maximum peak temperature and the tangential line showing the maximum inclination between the kickoff of the peak and the top of the peak by the determination mentioned above.

[Dispersibility of Crystalline Polyester]

The amount 0.1 g of toner is spread on a water slide glass (thickness: 1 mm, width: 26 mm, length: 76 mm), and excess toner was removed by gently shaking the slide to an extent that the toner can be observed as individual particles. The slide glass is placed on a hot plate at 200° C., and allowed to stand for 1 minute. Thereafter, the toner on the slide glass is observed at a magnification of 2000 using a microscope "KEYENCE VH-5910•SONY COLOR VIDEO PRINTER". The dispersion diameter of the crystalline polyester is analyzed by an image analyzer "LOOZEX (III)" (commercially available from NIRECO K.K.), and the dispersibility of the crystalline polyester is evaluated based on the following evaluation criteria.

(Evaluation Criteria)

1: Less than 90% by area of the dispersed domain is occupied by a crystalline polyester having a diameter of 2 μm or less.

2: Ninety percent by area or more of the dispersed domain is occupied by a crystalline polyester having a diameter of from 0.1 to 2 μm, and the dispersed domain having a diameter of from 0.1 to 1 μm is composed of less than 50% by area.

3: Ninety percent by area or more of the dispersed domain is occupied by a crystalline polyester having a diameter of from 0.1 to 2 μm, and the dispersed domain having a diameter of from 0.1 to 1 μm is composed of 50% by area or more and less than 90% by area.

4: Ninety percent by area or more of the dispersed domain is occupied by a crystalline polyester having a diameter of from 0.1 to 1 μm.

5: Ninety percent by area or more of the dispersed domain is occupied by a crystalline polyester having a diameter of 2 μm or less, and the dispersed domain of the crystalline polyester having a diameter of less than 0.1 μm is composed of exceeding 10% by area, or the dispersed domain is not able to be confirmed.

Preparation Example of Crystalline Polyester

A 5-liter four-necked flask equipped with a nitrogen inlet tube, a dehydration tube, a stirrer, and a thermocouple was charged with raw material monomers shown in Table 1, and 2 g of hydroquinone, and the ingredients were reacted at 160° C. over a period of 5 hours. Thereafter, the temperature was raised to 200° C., and the ingredients were reacted for 1 hour and further reacted at 8.3 kPa for 1 hour. The resulting resins are referred to as Resins a to c.

TABLE 1

| | Resin a | Resin b | Resin c |
|---|---|---|---|
| 1,4-Butanediol | 1013 g (90) | 1013 g (90) | 1013 g (90) |
| 1,6-Hexanediol | 143 g (10) | 143 g (10) | 143 g (10) |
| BPA-PO[1)] | | 218 g (5) | |
| Fumaric Acid | 1450 g (100) | 1450 g (100) | 1378 g (95) |
| Terephthalic Acid | | | 104 g (5) |
| Softening Point (° C.) | 122.0 | 113.1 | 112.6 |
| Maximum Peak Temperature (° C.) of Heat of Fusion | 124.6 | 115.8 | 114.3 |

Note) The amount used in parentheses represents a molar fraction of each of the alcohol component or the carboxylic acid component.

[1)]Propylene oxide adduct of bisphenol A (average number of moles added: 2.2 moles)

Preparation Example 1 of Amorphous Resin

A 5-liter four-necked flask equipped with a nitrogen inlet tube, a dehydration tube, a stirrer, and a thermocouple was charged with raw material monomers shown in Table 2, and 4 g of dibutyltin oxide, and the ingredients were reacted at 220° C. over a period of 8 hours. Thereafter, the ingredients were further reacted at 8.3 kPa until the desired softening point was attained. The resulting resins are referred to as Resins A and B.

Preparation Example 2 of Amorphous Resin

A 5-liter four-necked flask equipped with a dehydration tube with a rectification tower through which a hot water at 100° C. was passed, a nitrogen inlet tube, a stirrer, and a thermocouple was charged with raw material monomers shown in Table 2, and 4 g of dibutyltin oxide, and the ingredients were reacted at 180° to 210° C. over a period of 8 hours. Thereafter, the ingredients were further reacted at 8.3 kPa until the desired softening point was attained. The resulting resin is referred to as Resin C.

TABLE 2

| | Resin A | Resin B | Resin C |
|---|---|---|---|
| BPA-PO[1)] | 2000 g (51.3) | 2800 g (72.7) | |
| BPA-EO[2)] | 800 g (20.5) | | |
| Ethylene Glycol | | | 400 g (9.5) |
| Neopentyl Glycol | | | 1200 g (28.6) |
| Terephthalic Acid | 600 g (15.4) | 400 g (10.4) | 1900 g (45.2) |
| Dodecenylsuccinic Anhydride | 500 g (12.8) | | |
| Fumaric Acid | | 650 g (16.9) | |
| Trimellitic Acid Anhydride | | | 700 g (16.7) |
| Softening Point (° C.) | 150 | 92.3 | 143.2 |
| Maximum Peak Temperature (° C.) of Heat of Fusion | 66.0 | 54.5 | 67.1 |
| Glass Transition Point (° C.) | 62.3 | 50.5 | 64.9 |

Note) The amount used in parentheses is expressed in parts by weight
[1)]Propylene oxide adduct of bisphenol A (average number of moles added: 2.2 moles).
[2)]Ethylene oxide adduct of bisphenol A (average number of moles added: 2.2 moles).

Examples 1 to 3

A resin binder, a colorant, a charge control agent and a releasing agent, as shown in Table 3, were sufficiently mixed together with a Henschel mixer. Thereafter, the mixture was melt-kneaded under Kneading Conditions B (as described below), cooled and roughly pulverized. Subsequently, the resulting product was pulverized with a jet mill and classified, to give a powder having a volume-average particle size of 7.5 μm. To 100 parts by weight of the resulting powder was added 1.0 part by weight of a hydrophobic silica "AEROSIL R-972" (commercially available from Nippon Aerosil) as an external additive, and mixed with a Henschel mixer, to give a toner. The softening point of the resulting toner and the dispersibility of the crystalline polyester are shown in Table 4.

TABLE 3

| Example | Resin Binder | Kneading Conditions | Colorant | Charge Control Agent | Releasing Agent |
|---|---|---|---|---|---|
| 1 | a/A/C = 20/60/20 | B | MOGUL-L = 4 | T-77 = 1 | Carnauba = 1 |
| 2 | a/A/C = 20/60/20 | B | ECB-301 = 4 | LR-147 = 1 | Carnauba = 1 |
| 3 | a/A/C = 20/60/20 | B | MOGUL-L = 4 | T-77 = 1 | SP-105 = 1 |

Note) The used amount is expressed in parts by weight.
MOGUL-L: carbon black (commercially available from Cabot Corporation)
ECB-301: blue pigment (commercially available from DAINICHISEIKA COLOR & CHEMICALS MFG. CO., LTD.)
T-77: negatively chargeable charge control agent (commercially available from Hodogaya Chemical Co., Ltd.)
LR-147: negatively chargeable charge control agent (commercially available from Japan Carlit)
Carnauba (Carnauba Wax CI): natural wax (commercially available from K.K. Kato Yoko)
SP-105 (SPRAY 105): polyethylene wax (commercially available from Sazole)

Examples 4 to 9 and Comparative Examples 1 to 5

The same procedures as in Example 1 were carried out except that a resin binder and the kneading conditions shown in Table 4 were employed, to give a toner.

[Kneading Conditions A]

A continuous twin roller-type kneader having a roller diameter of 0.12 m and an effective roller length of 0.8 m is used. The rotational speed of a high-speed roller (front roller) is set at 75 rpm, the rotational speed of a low-speed roller (back roller) is set at 50 rpm, and the roller gap is set at 0.0001 m. The temperature of a heating medium at the raw material supplying side of the high-speed roller is set at 100° C., and the temperature of a cooling medium at the raw material supplying side of the low-speed roller is set at 80° C. In addition, the feeding rate of a mixture is 4 kg/hr, and the average residence time is about 10 minutes.

[Kneading Conditions B]

A twin-screw extruder with unidirectional rotations having a length of the kneading part of 1560 mm, a screw diameter of 42 mm and a Barrel inner diameter of 43 mm is used for kneading. The rotational speed of the roller is set at 200 rpm, and the heating temperature within the roller is set at 100° C. The feeding rate of a mixture is 10 kg/hr, and the average residence time is about 18 seconds.

Figure 2:
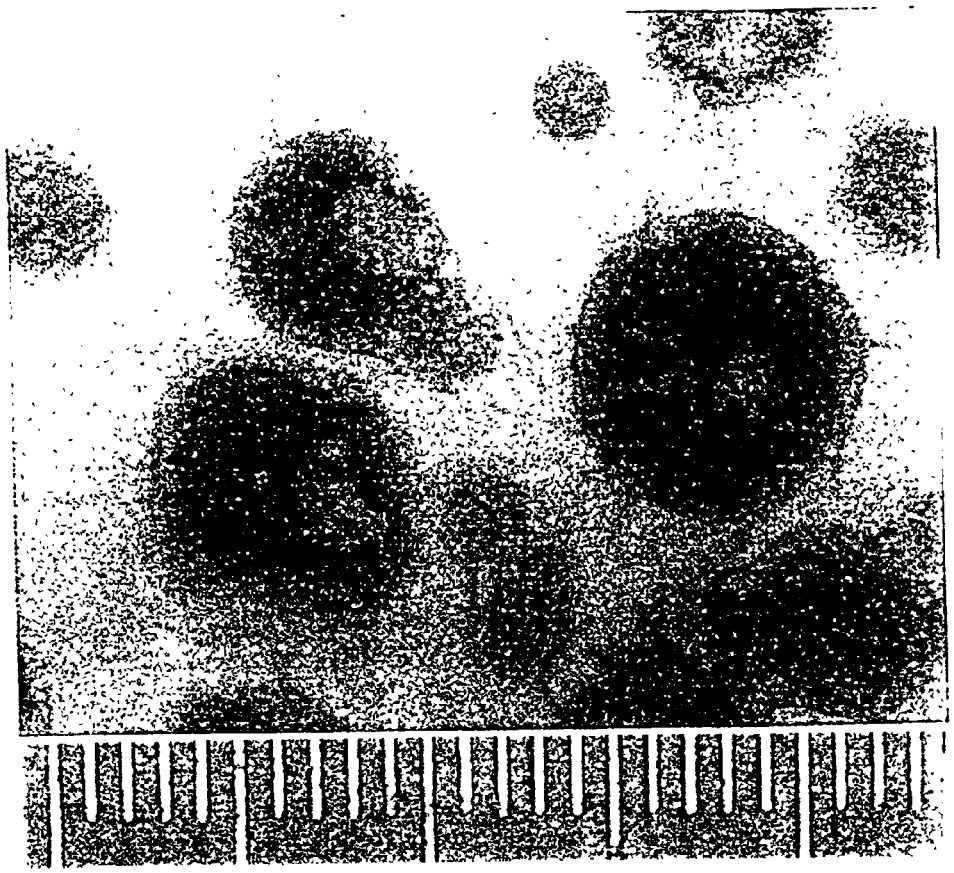
FIG. 2 is an electron micrograph of the toner obtained in Comparative Example 1 of the present specification, wherein a single measurement scale corresponds to a length of 1 $\mu$m.
Figure 3:
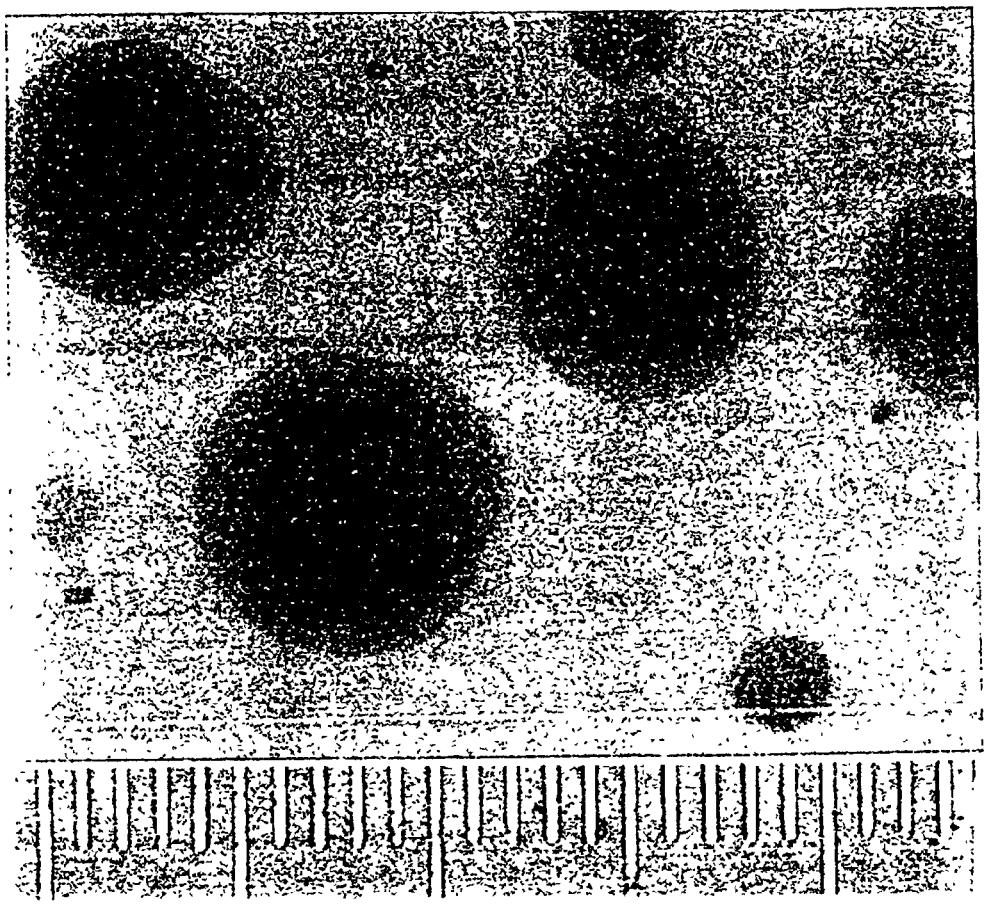
FIG. 3 is an electron micrograph of the toner obtained in Comparative Example 2 of the present specification, wherein a single measurement scale corresponds to a length of 1 $\mu$m.

The electron micrographs of the toners obtained in Example 5, Comparative Examples 1 and 2 are shown in FIGS. 1 to 3. The white spots in the internal of the toner represent a crystalline polyester. While the domains of the crystalline polyester are finely dispersed in the toner of Example 5 (FIG. 1), the crystalline polyester is unevenly dispersed in massive lumps in the toner of Comparative Example 1 (FIG. 2). Also, the crystalline polyester and the amorphous resin are substantially compatible with each other in the toner of Comparative Example 2, so that the domain of the crystalline polyester is not observed (FIG. 3).

Test Example 1

[Storage Property]

Four grams of a toner was allowed to stand under environmental conditions of a temperature of 45° C. and a humidity of 60% for 72 hours. The extent of the aggregation of the toner was visually determined, and the storage property was evaluated by the following evaluation criteria. The results are shown in Table 4.

[Evaluation Criteria]

◎: No aggregation being observed.

○: Substantially no aggregation being observed; and x: Aggregation being observed.

Test Example 2

[Low-Temperature Fixing Ability]

Four parts by weight of a toner and 96 parts by weight of a silicon-coated ferrite carrier (commercially available from Kanto Denka Kogyo Co., Ltd., average particle size: 90 μm) were mixed for 10 minutes with a turbuler mixer, to give a developer. Next, the resulting developer was loaded in a modified apparatus of a copy machine "AR-505" (commercially available from Sharp Corporation). The development of fixed images was carried out, with sequentially raising the temperature of the fixing roller from 90° to 240° C.

A sand-rubber eraser to which a load of 500 g was applied, the eraser having a bottom area of 15 mm×7.5 mm, was moved backward and forward five times over a fixed image obtained at each fixing temperature. The optical reflective density of the image before or after the eraser treatment was measured with a reflective densitometer "RD-915" manufactured by Macbeth Process Measurements Co. The temperature of the fixing roller at which the ratio of the optical density after the eraser treatment to the optical density before the eraser treatment initially exceeds 70% is defined as the lowest fixing temperature. The low-temperature fixing ability was evaluated by the following evaluation criteria. The results are shown in Table 4.

[Evaluation Criteria]

◎: A lowest fixing temperature being lower than 130° C.;

○: A lowest fixing temperature being 130° C. or higher and lower than 150° C.; and x: A lowest fixing temperature being 150° C. or higher.

Test Example 3

[Evenness of Fixed Image]

The same procedures were carried out as in Test Example 2 except that the fixing temperature was set at 200° C. A solid image of 5 cm×12 cm was printed at an average image density of 1.4 (measured with a reflective densitometer "RD-915" manufactured by Macbeth Process Measurements Co.), and image densities were measured at 10 points in the image. The more the unevenness of the triboelectric charges, the larger the variance of the image densities between the measured points, so that the resulting image quality is deteriorated. The evenness of fixed images was evaluated by the following evaluation criteria. The results are shown in Table 4.

[Evaluation Criteria]

The difference between the maximum value and the minimum value of the image densities measured is:

◎: less than 0.2;

○: 0.2 or more and less than 0.4; and x: 0.4 or more.

TABLE 4

| Ex. No. | Resin Binder (Parts by Weight) | Kneading Condition | Softening Point (° C.) of Toner | Dispers-ibility | Storage Property | Low-Temperature Fixing Ability | Evenness of Fixed Image |
|---|---|---|---|---|---|---|---|
| 1 | a/A/C = 20/60/20 | B | 138.3 | 4 | ◎ | ◎ | ◎ |
| 2 | a/A/C = 20/60/20 | B | 138.0 | 4 | ◎ | ◎ | ◎ |
| 3 | a/A/C = 20/60/20 | B | 138.7 | 3 | ◎ | ◎ | ◎ |
| 4 | a/C = 20/80 | B | 136.5 | 4 | ○ | ○ | ◎ |
| 5 | b/A = 20/80 | B | 140.2 | 3 | ◎ | ○ | ◎ |
| 6 | c/A = 20/80 | B | 140.7 | 2 | ◎ | ○ | ○ |
| 7 | a/A = 20/80 | A | 130.2 | 3 | ◎ | ○ | ◎ |

TABLE 4-continued

| | Resin Binder (Parts by Weight) | Kneading Condition | Softening Point (° C.) of Toner | Dispers-ibility | Storage Property | Low-Temperature Fixing Ability | Evenness of Fixed Image |
|---|---|---|---|---|---|---|---|
| 8 | a/A/C = 20/60/20 | A | 129.5 | 4 | ○ | ○ | ◎ |
| 9 | a/A = 35/65 | A | 128.1 | 2 | ○ | ◎ | ○ |
| Comp. Ex. No. | | | | | | | |
| 1 | a/A = 20/80 | B | 141.3 | 1 | ◎ | ○ | X |
| 2 | a/C = 20/80 | A | 127.7 | 5 | X | ○ | ◎ |
| 3 | a/A/B = 20/60/20 | B | 132.3 | 1 | ◎ | ○ | X |
| 4 | a/A = 60/40 | A | 125.3 | 2 | X | ◎ | ○ |
| 5 | A = 100 | A | 135.1 | — | ◎ | X | ◎ |

Note) The amount of resin used is expressed in parts by weight.

It is clear from the above results that the toners of Examples in which a crystalline polyester is appropriately dispersed are excellent in any of the storage property, low-temperature fixing ability and image quality. On the other hand, the toners of the Comparative Examples 1 and 3 in which a crystalline polyester is not sufficiently dispersed, have deteriorated fixed images due to the unevenness of the triboelectric charges, and the toner of Comparative Example 2 in which a crystalline polyester is substantially compatible with an amorphous polyester is poor in the storage property. Also, the toner of Comparative Example 4 in which a large amount of a crystalline polyester is contained is poor in the storage property, and the toner of Comparative Example 5 in which only an amorphous polyester is used as a resin binder is poor in the low-temperature fixing ability.

[Effects of the Invention]

According to the present invention, there can be provided a toner which has an excellent low-temperature fixing ability and excellent storage property, thereby giving high-quality fixed images.

What is claimed is:

1. A toner for electrophotography comprising a resin binder comprising a crystalline polyester and an amorphous resin, wherein said crystalline polyester is dispersed in the. resin binder in an amount of from 1 to 40% by weight, and wherein 90% or more of a dispersed domain of said crystalline polyester has a diameter of from 0.1 to 2 $\mu$m.

2. The toner according to claim 1, wherein the crystalline polyester has a softening point of 85° to 150° C.

3. The toner according to claim 1, wherein the crystalline polyester is obtained by polycondensing an alcohol component comprising 80% by mol or more of an aliphatic diol having 2 to 6 carbon atoms with a carboxylic acid component comprising 80% by mol or more of an aliphatic dicarboxylic acid compound having 2 to 8 carbon atoms, and wherein the amorphous resin is obtained by polymerizing a raw material monomer comprising 5 to 70% by weight of an aliphatic compound.

4. The toner according to claim 1, wherein the toner is obtained by a process comprising a step of melt-kneading components comprising the resin binder in a kneader.

5. The toner according to claim 1, wherein the amorphous resin is an amorphous polyester obtained by polycondensing an alcohol component and a carboxylic acid component, wherein at least one of the alcohol component and the carboxylic acid component comprises two or more compounds, of which each amount is from 10 to 70% by mol of the component, or comprises at least one compound selected from the group consisting of an alkylene oxide adduct of bisphenol A, an aromatic carboxylic acid compound, and a substituted succinic acid compound of which substituent is an alkyl group having 1 to 20 carbon atoms or an alkenyl group having 2 to 20 carbon atoms in an amount of 30% by mol or more.

6. The toner according to claim 1, wherein the crystalline polyester is obtained by polycondensing a raw material monomer comprising 0.1 to 10% by weight of an aromatic compound, and wherein the amorphous resin is obtained by polymerizing a raw material monomer comprising 50 to 95% by weight of an aromatic compound.

7. The toner according to claim 1, wherein the crystalline polyester is obtained by polycondensing an alcohol component comprising 80% by mol or more of an aliphatic diol having 2 to 6 carbon atoms with a carboxylic acid component comprising 80% by mol or more of an aliphatic dicarboxylic acid compound having 2 to 8 carbon atoms, arid wherein the amorphous resin comprises a resin obtained by polymerizing a raw material monomer comprising 50 to 95% by weight of an aromatic compound and a resin obtained by polymerizing a raw material monomer comprising 20 to 70% by weight of an aliphatic compound.

8. The toner according to claim 1, further comprising at least one wax selected from the group consisting of natural waxes, synthetic waxes, coal waxes, alcoholic waxes and ester waxes.

9. The toner according to claim 4, wherein the kneader is a continuous twin roller kneader.

10. The toner according to claim 1, wherein the crystalline polyester has a ratio of the softening point to the maximum peak temperature of heat of fusion is 0.9 to less than 1.1.

11. The toner according to claim 1, wherein said crystalline polyester is dispersed in the resin binder in an amount of from 1 to 35% by weight.

* * * * *